US005782954A

United States Patent [19]

Luk

[11] Patent Number: 5,782,954

[45] Date of Patent: Jul. 21, 1998

[54] IRON-BASED METALLURGICAL COMPOSITIONS CONTAINING FLOW AGENTS AND METHODS FOR USING SAME

[75] Inventor: Sydney Luk, Lafayette Hill, Pa.

[73] Assignee: Hoeganaes Corporation, Riverton, N.J.

[21] Appl. No.: 482,012

[22] Filed: Jun. 7, 1995

[51] Int. Cl.[6] ..... B22F 3/12

[52] U.S. Cl. ..... 75/252; 75/232; 419/19; 419/23; 419/36; 419/38

[58] Field of Search ..... 419/19, 23, 38, 419/65, 66, 36; 75/252, 232

[56] References Cited

U.S. PATENT DOCUMENTS

| | | | |
|---|---|---|---|
| 3,357,818 | 12/1967 | Findelsen et al. | 75/5 |
| 3,711,274 | 1/1973 | Montino et al. | 75/0.5 A |
| 4,316,834 | 2/1982 | Ueda et al. | 260/38 |
| 4,483,905 | 11/1984 | Engström | 428/570 |
| 4,676,831 | 6/1987 | Engström | 75/252 |
| 4,834,800 | 5/1989 | Semel | 106/403 |
| 4,909,840 | 3/1990 | Schlump | 75/232 |
| 5,063,011 | 11/1991 | Rutz et al. | 264/126 |
| 5,108,493 | 4/1992 | Causton | 75/255 |
| 5,134,039 | 7/1992 | Alexander et al. | 428/614 |
| 5,154,881 | 10/1992 | Rutz et al. | 419/38 |
| 5,198,137 | 3/1993 | Rutz et al. | 252/62.54 |
| 5,225,459 | 7/1993 | Oliver et al. | 523/220 |
| 5,298,055 | 3/1994 | Semel et al. | 75/252 |
| 5,328,500 | 7/1994 | Beltz et al. | 75/343 |
| 5,368,630 | 11/1994 | Luk | 75/252 |
| 5,368,812 | 11/1994 | Calka et al. | 419/5 |
| 5,541,006 | 7/1996 | Conley | 428/552 |
| 5,603,075 | 2/1997 | Stoll et al. | 428/552 |

*Primary Examiner*—Daniel J. Jenkins
*Attorney, Agent, or Firm*—Woodcock Washburn Kurtz Mackiewicz & Norris, LLP

[57] ABSTRACT

The present invention provides for iron-based metallurgical powder compositions that contain nanoparticle metal or metal oxide flow agents useful for enhancing the flow characteristics of the compositions, particularly at elevated processing temperatures. The iron-based powder compositions can be advantageously blended with a flow agent such as a silicon oxide or iron oxide, or a combination of both, to provide a powder composition having improved flow properties and ejection release characteristics.

53 Claims, No Drawings

IRON-BASED METALLURGICAL COMPOSITIONS CONTAINING FLOW AGENTS AND METHODS FOR USING SAME

FIELD OF THE INVENTION

The present invention relates to iron-based metallurgical powder compositions. More particularly, the present invention relates to such compositions containing flow agents to improve the flow characteristics of the powder compositions, particularly at elevated processing temperatures.

BACKGROUND OF THE INVENTION

In the art of powder metallurgy, a metallurgical powder composition is used to produce metal parts in accordance with well established techniques. Generally, the metallurgical powder is poured into a compaction die and compacted under high pressure, and in some circumstances elevated temperatures, to form the compacted, or "green", part. This green part is then sintered to form a cohesive metallic part. The sintering operation also burns off any organic materials, such as the residue of any die lubricant or internal lubricant, from the metallic material.

The speed and efficiency at which such parts can be produced is affected by the flow characteristics of the metallurgical powder. In most production processing techniques, the metallurgical powder must flow, by gravity, from a storage bin into a container, or "shoe", that transports the powder from the storage site to the die. The powder is then poured from the shoe into the die cavity. The speed at which the powder can flow is a rate determining step for the manufacturing of parts in many instances.

There is currently an increasing demand for metallurgical powder compositions, particularly iron-based powder compositions, that can be utilized in compaction operations conducted at "warm" pressing conditions. Improved powder compositions useful in such compaction operations are set forth in U.S. Pat. No. 5,154,881 to Rutz and Luk, which is incorporated herein by reference in its entirety. Generally, the powder and/or the die cavity is heated, to a temperature up to about 370° C., for compaction. In certain instances, it is desired to preheat the powder compositions to at least about 150° C. or higher to increase the efficiency of such compaction processing. However, it has been found that the flow ability of certain iron-based powder compositions is adversely affected by those processing temperatures.

Thus, there exists a need in the powder metallurgy art to produce iron-based metallurgical powder compositions having improved flow characteristics. There exists a particular need to prepare such iron-based powder compositions that have improved flow characteristics at elevated temperatures associated with warm compaction operations.

SUMMARY OF THE INVENTION

The present invention provides iron-based metallurgical powder compositions that are characterized by having superior flow properties, particularly at elevated temperatures associated with warm compaction operations. The invention also provides methods for using the powder compositions to produce compacted parts. According to the present invention, a flow agent is incorporated into an iron-based powder composition; the presence of the flow agent enhances the flowability of the powder composition, particularly at elevated temperatures.

The flow agent materials are nanoparticles of various metals and their oxides. Typically, the metal and metal oxide powders have average particle sizes below about 500 nanometers. In one embodiment of the present invention, the iron-based powder composition is blended with a silicon oxide flow agent. The silicon oxide flow agents are preferably blended with the iron-based powders in an amount of from about 0.005 to about 2 percent by weight of the resultant powder composition. The preferred silicon oxide flow agents are powders or particles of silicon dioxide having an average particle size below about 40 nanometers.

In another embodiment of the present invention, the iron-based powder composition is blended with an iron oxide flow agent. The preferred iron oxide flow agents have an average particle size below about 500 nanometers. The iron oxide flow agents are preferably blended with the iron-based powders in an amount of from about 0.01 to about 2 percent by weight of the resultant powder composition. It is particularly advantageous to blend the iron oxide flow agents with the silicon oxide flow agents.

The addition of the flow agents is particularly beneficial for enhancing the flow properties of those iron-based powder compositions used in warm compaction processes. As such, the compositions preferably include a lubricant specifically designed for such warm compaction applications, and where necessary, a binding agent specifically designed for such applications.

It has further been found that the addition of the flow agents unexpectedly reduces the ejection forces required to remove the compacted part from the die. Thus, the addition of the flow agents of this invention is believed to reduce die wear.

DETAILED DESCRIPTION OF THE INVENTION

The present invention provides improved metallurgical powder compositions having superior flow characteristics, particularly at elevated temperatures. The metallurgical powder compositions are generally those containing an iron-based powder, and optionally a lubricant powder and/or a binding agent, and are improved by the further addition of a flow agent powder having a defined particle size distribution.

The metal powder compositions that are the subject of the present invention contain iron-based powders of the kind generally used in powder metallurgical methods. Examples of "iron-based" powders, as that term is used herein, are powders of substantially pure iron; particles of iron prealloyed with other elements (for example, steel-producing elements) that enhance the strength, hardenability, electromagnetic properties, or other desirable properties of the final product; particles of iron to which such other elements have been diffusion bonded; and particles of iron in admixture with particles of such alloying elements. The iron-based powders generally constitute at least about 85 percent by weight and more commonly at least about 90 percent by weight of the metal powder composition.

Substantially pure iron powders that can be used in the invention are powders of iron containing not more than about 1.0% by weight, preferably no more than about 0.5% by weight, of normal impurities. Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85–3.00 g/cm$^3$, typically 2.94 g/cm$^3$. Other iron powders that can be used in the invention are typical sponge iron powders, such as Hoeganaes' ANCOR MH-100 powder.

The iron-based powders can also include iron, preferably substantially pure iron, that has been pre-alloyed, diffusion bonded, or admixed with one or more alloying elements. Examples of alloying elements that can be combined with the iron particles include, but are not limited to, molybdenum; manganese; magnesium; chromium; silicon; copper; nickel; gold; vanadium; columbium (niobium); graphite; phosphorus; aluminum; binary alloys of copper and tin or phosphorus; ferro-alloys of manganese, chromium, boron, phosphorus, or silicon; low melting ternary and quaternary eutectics of carbon and two or three of iron, vanadium, manganese, chromium, and molybdenum; carbides of tungsten or silicon; silicon nitride; aluminum oxide; and sulfides of manganese or molybdenum, and combinations thereof. Typically, the alloying elements are generally combined with the iron powder, preferably the substantially pure iron powder in an amount of up to about 7% by weight, preferably from about 0.25% to about 5% by weight, more preferably from about 0.25% to about 4% by weight, although in certain specialized uses the alloying elements may be present in an amount of from about 7% to about 15% by weight, of the iron powder and alloying element.

The iron-based powders can thus include iron particles that are in admixture with the alloying elements that are in the form of alloying powders. The term "alloying powder" as used herein refers to any particulate element or compound, as previously mentioned, physically blended with the iron particles, whether or not that element or compound ultimately alloys with the iron powder. The alloying-element particles generally have a weight average particle size below about 100 microns, preferably below about 75 microns, more preferably below about 30 microns, and most preferably in the range of about 5–20 microns. Binding agents are preferably included in admixtures of iron particles and alloying powders to prevent dusting and segregation of the alloying powder from the iron powder. Examples of commonly used binding agents include those set forth in U.S. Pat. Nos. 4,483,905 and 4,676,831, both to Engström, and in U.S. Pat. No. 4,834,800 to Semel, all of which are incorporated by reference herein in their entireties. Binding agents can be blended into the metal powder compositions in amounts of from about 0.005–3% wt., preferably about 0.05–1.5% wt., and more preferably about 0.1–1% wt., based on the weight of the iron and alloying powders.

The iron-based powder can further be in the form of iron that has been pre-alloyed with one or more of the alloying elements. The pre-alloyed powders can be prepared by making a melt of iron and the desired alloying elements, and then atomizing the melt, whereby the atomized droplets form the powder upon solidification. The amount of the alloying element or elements incorporated depends upon the properties desired in the final metal part. Pre-alloyed iron powders that incorporate such alloying elements are available from Hoeganaes Corp. as part of its ANCORSTEEL line of powders.

A further example of iron-based powders is diffusion-bonded iron-based powder, example is a powder which are particles of substantially pure iron that have a layer or coating of one or more other metals, such as steel-producing elements and the alloying elements set forth above, diffused into their outer surfaces. Such commercially available powders include DISTALOY 4600A diffusion bonded powder from Hoeganaes Corporation, which contains about 1.8% nickel, about 0.55% molybdenum, and about 1.6% copper, and DISTALOY 4800A diffusion bonded powder from Hoeganaes Corporation, which contains about 4.05% nickel, about 0.55% molybdenum, and about 1.6% copper.

A preferred iron-based powder is of iron pre-alloyed with molybdenum (Mo). The powder is produced by atomizing a melt of substantially pure iron containing from about 0.5 to about 2.5 weight percent Mo. An example of such a powder is Hoeganaes' ANCORSTEEL 85HP steel powder, which contains about 0.85 weight percent Mo, less than about 0.4 weight percent, in total, of such other materials as manganese, chromium, silicon, copper, nickel, molybdenum or aluminum, and less than about 0.02 weight percent carbon. Another example of such a powder is Hoeganaes' ANCORSTEEL 4600V steel powder, which contains about 0.5–0.6 weight percent molybdenum, about 1.5–2.0 weight percent nickel, and about 0.1–0.25 weight percent manganese, and less than about 0.02 weight percent carbon.

Another pre-alloyed iron-based powder that can be used in the invention is disclosed in U.S. Pat. No. 5,108,493 to Causton, entitled "Steel Powder Admixture Having Distinct Pre-alloyed Powder of Iron Alloys," which is herein incorporated in its entirety. This steel powder composition is an admixture of two different pre-alloyed iron-based powders, one being a pre-alloy of iron with 0.5–2.5 weight percent molybdenum, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition. An example of such a powder is commercially available as Hoeganaes' ANCORSTEEL 41 AB steel powder, which contains about 0.85 weight percent molybdenum, about 1 weight percent nickel, about 0.9 weight percent manganese, about 0.75 weight percent chromium, and about 0.5 weight percent carbon.

Other iron-based powders that are useful in the practice of the invention are ferromagnetic powders. An example is a composition of substantially pure iron powders in admixture with powder of iron that has been pre-alloyed with small amounts of phosphorus.

Still further iron-based powders that are useful in the practice of the invention are iron particles coated with a thermoplastic material to provide a substantially uniform coating of the thermoplastic material as described in U.S. Pat. No. 5,198,137 to Rutz et al., which is incorporated herein in its entirety. Preferably, each particle has a substantially uniform circumferential coating about the iron core particle. Sufficient thermoplastic material is used to provide a coating of about 0.001–15% by weight of the iron particles as coated. Generally the thermoplastic material is present in an amount of at least 0.2% by weight, preferably about 0.4–2% by weight, and more preferably about 0.6–0.9% by weight of the coated particles. Preferred are those thermoplastics such as polyethersulfones, polyetherimides, polycarbonates, or polyphenylene ethers, having a weight average molecular weight in the range of about 10,000 to 50,000. Other polymeric coated iron-based powders include those containing an inner coating of iron phosphate as set forth in U.S. Pat. No. 5,063,011 to Rutz et al., which is incorporated herein in its entirety.

The particles of pure iron, pre-alloyed iron, diffusion bonded iron, or thermoplastic coated iron can have a weight average particle size as small as one micron or below, or up to about 850–1,000 microns, but generally the particles will have a weight average particle size in the range of about 10–500 microns. Preferred are those having a maximum number average particle size up to about 350 microns, preferably 50–150 microns.

The flow behavior of composition of iron-based powders is an important physical characteristic for it directly affects the rate at which parts can be manufactured by using conventional powder metallurgy techniques. The present invention provides for the improvement of the flow of the generally known and used iron-based powders by incorporating a particulate flow agent. It has been found that the presence of the flow agent, having a defined particle size distribution, enhances the flow characteristics of the metal powder composition, particularly at elevated temperatures. The flow agent should not adversely effect the compactability of the powder composition, nor should it adversely effect the compacted (green) or sintered properties of the resulting parts.

The flow agents of the present invention can be referred to as "nanoparticles" in that they are particulate materials wherein a majority of the powder has a particle diameter below 1 micron. The particle size distribution of the flow agents can be determined by various means. The term "average particle size" as used with respect to the present invention is determined, on a weight basis, in accordance with formula (I):

$$APS=6/(\rho \times SA) \quad (I)$$

where

APS=average particle size

ρ=density of the powder

SA=surface area of the powder

The density of the powder is determined using standard procedures such as those set forth in testing standard ASTM D70. The surface area is the BET (Brunauer, Emmett, Teller) surface area determined using standard procedures such as those set forth in ASTM D4820. The particle size distribution can be verified by means of electron microscopy, which can be used to visually examine the particle size of the powder.

The flow agents can be selected from those metals and metal oxides having average particle sizes below about 500 nm, preferably below about 250 nm, and more preferably below about 100 nm, and are thus referred to as nanoparticle materials. Representative metals that can be used as the nanoparticle materials in either their metal or metal oxide forms include silicon, aluminum, copper, iron, nickel, titanium, gold, silver, platinum, palladium, bismuth, cobalt, manganese, magnesium, lead, tin, vanadium, yttrium, niobium, tungsten, and zirconium. Such materials are commercially available from ULTRAM International. These nanoparticle materials are present in the metallurgical compositions in an amount of from about 0.005 to about 2 percent by weight, preferably from about 0.01 to about 1 percent by weight, and more preferably from about 0.025 to about 0.5 percent by weight, based on the total weight of the metallurgical composition. Preferred flow agents are oxides of silicon, and the other nanoparticle materials can be beneficially admixed with the silicon oxides to further enhance the flow of the metallurgical powder composition.

The silicon oxides particularly useful in the practice of the present invention are those that have a surface area of between about 75 and about 600 $m^2/g$, preferably between about 100 and about 500 $m^2/g$, and more preferably between about 150 and about 500 $m^2/g$. The density of the silicon oxides is preferably between about 0.02 and about 0.15 $g/cm^3$, preferably between about 0.035 and about 0.1 $g/cm^3$, more preferably between about 0.04 and about 0.08 $g/cm^3$. The silicon oxides have an average particle size, determined in accordance with formula (I) above (and generally a number average particle size determined by electron microscopy visual examination) below about 40 nanometers (nm), advantageously between about 1 to about 35 nm, preferably between about 1 and about 25 nm, more preferably between about 5 and about 20 nm. The particle size distribution of the silicon oxide is preferably such that about 90 percent, on a number basis of the particles are below about 100 nm, preferably below 75 nm, and more preferably below about 50 nm.

The silicon oxides are present in the metallurgical compositions in an amount of from about 0.005 to about 2 percent by weight, preferably from about 0.01 to about 1 percent by weight, and more preferably from about 0.025 to about 0.5 percent by weight, based on the total weight of the metallurgical composition. Preferred silicon oxides are the silicon dioxide materials, both hydrophilic and hydrophobic forms, commercially available as the Aerosil line of silicon dioxides, such as the Aerosil 200 and R812 products, from Degussa Corporation.

Another preferred class of flow agents are oxides of iron. The iron oxides useful in the practice of the present invention are those that have a surface area of between about 2 and about 150 $m^2/g$, preferably between about 5 and about 50 $m^2/g$, and more preferably between about 5 and about 20 $m^2/g$. The density of the silicon oxides is generally between about 3 and about 5 $g/cm^3$, preferably between about 4 and about 5 $g/cm^3$, more preferably between about 4.4 and about 4.7 $g/cm^3$. The iron oxides will preferably have an average particle size, determined in accordance with formula (I) above (and generally a number average particle size determined by electron microscopy visual examination) of below about 500 nm, advantageously between about 10 to about 400 nm, preferably between about 25 and about 300 nm, more preferably between about 40 and about 200 nm. The particle size distribution of the iron oxide is preferably such that about 90 percent, on a number basis, of the particles are below about 1 micron, preferably below 750 nm, and more preferably below 500 nm.

The iron oxides are present in the metallurgical compositions in an amount of from about 0.01 to about 2 percent by weight, preferably from about 0.05 to about 1 percent by weight, and more preferably from about 0.05 to about 0.5 percent by weight, based on the total metallurgical composition. Preferred iron oxides are the $Fe_3O_4$ materials. For example useful iron oxides are those commercially available as the Bayferrox line of iron oxides, such as the Bayferrox 318M and 330 pigment products, from Miles Inc. It is preferred to use the iron oxide materials in conjunction with the silicon oxide materials to provide synergistic flow enhancement properties to the metal powder composition.

The metal powder compositions of the present invention can further contain a lubricant to reduce the ejection force required to remove the compacted part from the die cavity. Examples of typical powder metallurgy lubricants include the stearates, commonly zinc stearate and lithium stearate; synthetic waxes, such as ethylene bisstearamide, along with such lubricants as molybdenum sulfides, boron nitride, and boric acid. The lubricant is generally present in the metal powder composition in an amount up to about 15 weight percent, preferably from about 0.1 to about 10 weight percent, more preferably about 0.1–2 weight percent, and most preferably about 0.2–1 weight percent, of the metal powder composition.

The metal powder compositions of the present invention are compacted in a die according to standard metallurgical techniques. Typical compaction pressures range between about 5 and 200 tons per square inch (tsi) (69–2760 MPa), preferably from about 20–100 tsi (276–1379 MPa), and more preferably from about 25–60 tsi (345–828 MPa). Following compaction, the part can be sintered, according to standard metallurgical techniques, at temperatures and other conditions appropriate to the composition of the iron-based powder. Those metal powder compositions containing a thermoplastic coating are generally not sintered following compaction, but are rather subjected to a post-compaction heat treatment, such as that described in U.S. Pat. No. 5,225,459 to Oliver and Clisby, which is hereby incorporated by reference in its entirety.

The oxide flow agents of the present invention have been found to advantageously improve the flow characteristics of those metal powder compositions designed for compaction at "warm" temperature conditions. Compaction in accordance with warm temperature techniques generally requires that the metal powder composition is compressed at a compaction temperature—measured as the temperature of the composition as it is being compacted—up to about 370° C. (700° F.). The compaction is generally conducted at a temperature above 100° C. (212° F.) and commonly above about 125° C. (260° F.), preferably at a temperature of from about 150° C. (300° F.) to about 370° C. (700° F.), more preferably from about 175° C. (350° F.) to about 260° C. (500° F.). The metal powder compositions designed for use at warm compaction conditions preferably contain a lubricant adopted for high temperature compaction. When the iron-based powder that is to be warm compacted is of the kind that contains particles of alloying elements, the composition usually contains a binder to prevent segregation and dusting. A useful high temperature lubricant and various binding agents that perform well in such compositions intended for warm compaction are set forth in U.S. Pat. No. 5,368,630 to Luk, which is incorporated herein by reference in its entirety.

The high temperature lubricant described U.S. Pat. No. 5,368,630 is a polyamide lubricant that is, in essence, a high melting-point wax. The lubricant is the condensation product of a dicarboxylic acid, a monocarboxylic acid, and a diamine. The dicarboxylic acid is a linear acid having the general formula HOOC(R)COOH where R is a saturated or unsaturated linear aliphatic chain of 4–10, preferably about 6–8, carbon atoms. Preferably, the dicarboxylic acid is a $C_8$–$C_{10}$ saturated acid. Sebacic acid is a preferred dicarboxylic acid. The dicarboxylic acid is present in an amount of from about 10 to about 30 weight percent of the starting reactant materials. The monocarboxylic acid is a saturated or unsaturated $C_{10}$–$C_{22}$ fatty acid. Preferably, the monocarboxylic acid is a $C_{12}$–$C_{20}$ saturated acid. Stearic acid is a preferred saturated monocarboxylic acid. A preferred unsaturated monocarboxylic acid is oleic acid. The monocarboxylic acid is present in an amount of from about 10 to about 30 weight percent of the starting reactant materials. The diamine has the general formula $(CH_2)_x(NH_2)_2$ where x is an integer of about 2–6. Ethylene diamine is the preferred diamine. The diamine is present in an amount of from about 40 to about 80 weight percent of the starting reactant materials. The condensation reaction is preferably conducted at a temperature of from about 260°–280° C. and at a pressure up to about 7 atmospheres. The reaction is allowed to proceed to completion, usually not longer than about 6 hours. The polyamide is preferably produced under an inert atmosphere such as nitrogen. The reaction is preferably carried out in the presence of a catalyst such as 0.1 weight percent methyl acetate and 0.001 weight percent zinc powder. The lubricants formed by the condensation reaction are polyamides characterized as having a melting range rather than a melting point. As those skilled in the art will recognize, the reaction product is generally a mixture of moieties whose molecular weights, and therefore properties dependent on such, will vary. As a whole, the polyamide lubricant begins to melt at a temperature between about 150° C. (300° F.) and 260° C. (500° F.), preferably about 200° C. (400° F.) to about 260° C. (500° F.). The polyamide will generally be fully melted at a temperature about 250 degrees centigrade above this initial melting temperature, although it is preferred that the polyamide reaction product melt over a range of no more than about 100 degrees centigrade. A preferred lubricant is commercially available as ADVAWAX 450, or PROMOLD 450, polyamide sold by Morton International of Cincinnati, Ohio, which is an ethylene bis-stearamide having an initial melting point between about 200° C. and 300° C. The high temperature lubricant will generally be added to the composition in the form of solid particles. The particle size of the lubricant can vary, but is preferably below about 100 microns. Most preferably the lubricant particles have a weight average particle size of about 10–50 microns.

The binding agents described in U.S. Pat. No. 5,368,630 are polymeric resin materials that can be either soluble or insoluble in water, although it is preferred that the resin is insoluble in water. Preferably, the resin will have the capacity to form a film, in either its natural liquid state or as dissolved in a solvent, around the iron-based powder and the alloying powder. It is important that the binding agent resin is selected such that it will not adversely affect the elevated temperature compaction process. The binding agent should also pyrolyze cleanly upon sintering of the compacted part thus avoiding the deposition of organic material on the surface of the part that could cause a decrease in mechanical properties. Preferred binding agents include cellulose ester resins such as cellulose acetates having a number average molecular weight (MW) of from about 30,000–70,000, cellulose acetate butyrates having a MW of from about 10,000–100,000, cellulose acetate propionates having a MW of from about 10,000–100,000, and mixtures thereof. Also useful are high molecular weight thermoplastic phenolic resins having a MW of from about 10,000–80,000, and hydroxyalkylcellulose resins wherein the alkyl moiety has from 1–4 carbon atoms having a MW of from about 50,000–1,200,000, and mixtures thereof.

The flow agents of this invention can be blended with the iron-based powder to form the metallurgical composition by conventional blending techniques. Generally, the iron-based powder, including the alloying powder if present, is blended with any of the lubricants, binding agents, and the flow agents of the present invention in any order. In those embodiments where the metal powder contains an iron-based powder that is a powder of iron admixed with an alloying powder, along with a binding agent, and a lubricant, the metal powder mixture can be prepared in accordance with the procedures set forth in U.S. Pat. No. 5,368,630. Generally, the binding agent is admixed, preferably in liquid form, with the powders for a time sufficient to achieve good wetting of the powders. The binding agent is preferably dissolved or dispersed in an organic solvent to provide better dispersion of the binding agent in the powder mixture, thus providing a substantially homogeneous distribution of the binding agent throughout the mixture. The lubricant can be added, generally in its dry particulate form, either before or after the addition of the binding agent. Preferably, the lubricant, along with the iron-based powder are first dry blended, after which the binding agent is applied to the metal powder composition and any solvent removed, followed by the addition, by dry blending, of the flow agent.

The sequence of addition of the binding agent and lubricant can be varied to alter the final characteristics of the powder composition. Two other blending methods can be used in addition to the blending method described in which the binding agent is added after the lubricant has been mixed with the iron-based powder. In a preferred method, a portion of the lubricant, from about 50 to about 99 weight percent, preferably from about 75 to about 95 weight percent, is added to the iron-based powder, then the binding agent is added, followed by removal of the solvent, and subsequently the rest of the lubricant is added to the metal powder composition. The other method is to add the binding agent first to the iron-based powder, remove the solvent, and subsequently add the entire amount of the lubricant. The flow agent is then admixed to the thus formed metal powder compositions.

It has been found that the flow agents of this invention provide an additional benefit during the compaction process in that they reduce both the peak ejection force and the peak ejection pressure required to remove the compacted part from the die cavity. As such, the flow agents also can function as internal lubricants during the compaction process.

EXAMPLES

Example 1

The improvement to the flow characteristics of a metal powder composition from the incorporation of a silicon dioxide powder as a flow agent were studied. The flow was determined according to standard testing procedure ASTM B213-77, where the flow apparatus was maintained within a temperature controlled enclosure.

A metal powder composition was made having a composition as set forth in Table 1.1. This powder was prepared by blending the ANCORSTEEL 1000B powder, the graphite powder, and about 90% wt. of the lubricant powder in standard laboratory bottle-mixing equipment for about 15–30 minutes. The binding agent, dissolved in acetone (about 10% wt. binding agent) was then poured into the mixture and blended with a spatula in an appropriately sized steel bowl until the powder was well wetted. The solvent was then removed by air drying, and the mixture was coaxed through a 60-mesh screen to break up any large agglomerates that may have formed during the drying, however no significant agglomeration was noticed. Finally, the remaining amount of lubricant was blended with the powder composition. Blending was conducted until the powder composition reached a substantially homogeneous state.

TABLE 1.1

| Reference Mix | |
|---|---|
| Component | Wt. % |
| ANCORSTEEL 1000B[1] | 99 |
| Graphite[2] | 0.4 |
| Lubricant[3] | 0.45 |
| Binder[4] | 0.15 |

[1] - Pure iron powder; Hoganaes Corp.
[2] - Asbury 3203; Asbury Graphite Mills, Inc.
[3] - PROMOLD 450; Morton International
[4] - Cellulose acetate butyrate CAB-381; Eastman Chemical Products, Inc.

The metal powder composition set forth in Table 1.1 functioned as the control powder. A small amount of two different silicon dioxide powders was then blended into the control powder in the amount shown in Table 1.2 as a weight percentage of the control powder composition. Mix A utilized flow agent Aerosil 200 (average particle size=12 nm) and mix B utilized flow agent Aersoil R812 (average particle size=7nm), both available from Degussa Corporation. The results of the flow characteristics are set forth in Table 1.2, where it is shown that the flow characteristics of the metal powder are extended beyond 200° F. (95° C.) by the addition of both flow agents. Such an extension enables these powder compositions to be used in warm compaction processing where it is desired to heat the powder to higher temperatures approaching the die temperature prior to compaction. The designation NF signifies that the powder did not flow under the stated conditions.

TABLE 1.2

| | WT. % FLOW | TEMPERATURE (°F.) | | | |
|---|---|---|---|---|---|
| MIX | AGENT | 70 | 200 | 250 | 300 |
| A | 0.03 | 26.7 | 23.3 | 25.6 | 29.3 |
| B | 0.03 | 27.0 | 24.3 | 27.3 | NF |
| Ref | 0 | 22.3 | 29.0 | NF | NF |

Example 2

The improvement in the flow characteristics of a powder composition containing a ferrophosphorus alloying powder by the addition of a flow agent according to the present invention was studied. A base powder composition as set forth in Table 2.1 was used as the reference powder, where the lubricant and binder were the same as in Example 1. This powder was prepared by dry blending the ANCORSTEEL 1000B powder with the ferrophosphorus powder (15–16% wt. P; Hoganas, Sweden) and then admixing the binding agent, dissolved in acetone (about 10% wt. binding agent), and blending with a spatula in an appropriate sized steel bowl until the powder was well wetted. The solvent was then removed by air drying, and the mixture was coaxed through a 60-mesh screen to break up any large agglomerates that may have formed during the drying, however no significant agglomeration was noticed. Finally, the entire amount of lubricant was blended with the powder composition. Blending was conducted until the powder composition reached a substantially homogeneous state.

TABLE 2.1

| Reference Mix | |
|---|---|
| Component | Wt. % |
| ANCORSTEEL 1000B | 96.5 |
| $Fe_3P$ | 2.9 |
| Lubricant | 0.45 |
| Binder | 0.15 |

Various amounts of the flow agent Aerosil 200 silicon dioxide powder as used in Example 1 were mixed into the reference blend in the weight percents (of the control powder composition) set forth in Table 2.2 to form mixes C–E. The results of the flow characteristics are set forth in Table 2.2, where it is shown that the flow characteristics of the reference powder are significantly improved upon the addition of the silicon dioxide powder.

TABLE 2.2

| MIX | WT. % FLOW AGENT | TEMPERATURE (°F.) 70 | 200 | 260 | 270 | 280 | 290 |
|---|---|---|---|---|---|---|---|
| C | 0.04 | 26.7 | 23.3 | 23.0 | 23.6 | 25.4 | NF |
| D | 0.08 | 26.0 | 23.5 | 23.4 | 23.0 | 22.7 | 24.6 |
| E | 0.12 | 25.6 | 23.9 | 24.3 | 23.7 | 23.4 | 24.5 |
| Ref | 0 | 22.3 | 29.0 | NF | NF | NF | NF |

Example 3

The flow characteristics of the metal powder compositions containing a silicon dioxide flow agent were enhanced further by the addition of an iron oxide, $Fe_3O_4$, flow agent. Two different $Fe_3O_4$ powders were used, Bayferrox 318M and 330 pigments, available from Miles, Inc. The 318M powder (average particle size=100 nm) was used in Mixes F–G, and the 330 powder (average particle size=200 nm) was used in Mix H. The powder compositions were prepared by blending the $Fe_3O_4$ powders with the Mix C from Example 2 using bottle mixing techniques. Mixes F and H contained 0.08% wt. iron oxide and Mix G contained 0.12% wt. iron oxide, based on the weight of Mix C. The flow properties of these Mixes are set forth in Table 3.1.

TABLE 3.1

| MIX | WT. % IRON OXIDE | TEMPERATURE (°F.) 70 | 200 | 260 | 270 | 280 | 290 | 300 | 310 | 320 | 330 |
|---|---|---|---|---|---|---|---|---|---|---|---|
| F | 0.08 | 26.1 | 23.5 | 24.0 | 24.5 | 24.6 | 27.0 | 28.4 | NF | NF | NF |
| G | 0.12 | 26.2 | 23.9 | 24.0 | 24.5 | 24.6 | 27.9 | 30.0 | 30.1 | 30.6 | 31.5 |
| H | 0.08 | 27.5 | 22.3 | 22.9 | 24.7 | 28.5 | 30.8 | NF | NF | NF | NF |

Through the addition of the flow agents, the metal powder compositions can be processed at increasingly high temperatures.

Example 4

The effects on the ejection forces required to remove the compacted part from the die cavity were studied with the unexpected finding that the addition of the flow agents significantly reduced both the peak ejection force and peak ejection pressure. The peak ejection force is defined as the maximum force per unit cross-sectional area of the die cavity registered during the ejection of the compacted part from the die—this is a measure of the maximum force applied to the punch to push the compacted part out of the die cavity. The peak ejection pressure is calculated as the quotient of the maximum load during ejection divided by the total cross-sectional area of the part in contact with the die surface—this is a measure of the maximum friction force between the surfaces of the compacted part and the die that must be overcome to finish the ejection process.

A reference composition mix was prepared as set forth in Table 4.1 using the same FeP powder, lubricant, and binder as used in Example 2. Experimental mixes C1, D1, E1, and F1 were prepared containing similar amounts of the flow agent(s) as mixes C–F in Examples 2–3. That is, 0.04% wt., 0.08% wt., and 0.12% wt. of Aerosil 200 silicon dioxide powder was added to the reference mix to form mixes C1, D1, and E1, respectively, and 0.04% wt. Aerosil 200 powder and 0.08% wt. Bayferrox 318M $Fe_3O_4$ powder were added to the reference mix to from mix F1.

TABLE 4.1

| Reference Mix Component | Wt. % |
|---|---|
| ANCORSTEEL 1000B | 96.5 |
| $Fe_3P$ | 2.9 |
| Lubricant | 0.45 |
| Binder | 0.15 |

The mixes were then compacted at a pressure of 50 tons per square inch (tsi) at a temperature of about 300° F. (150° C.). The peak ejection forces and peak ejection pressures are shown in Table 4.2. The presence of the flow agents markedly reduced the ejection force and pressure thus providing a further benefit from their incorporation into the metal powder compositions.

TABLE 4.2

| MIX | PEAK EJECTION FORCE (tsi) | PEAK EJECTION PRESSURE (ksi) |
|---|---|---|
| Reference | 3.62 | 7.2 |
| C1 | 2.86 | 5.7 |
| D1 | 2.83 | 5.7 |
| E1 | 2.79 | 5.6 |
| F1 | 3.05 | 6.1 |

Example 5

The benefits from the addition of the flow agent to the flow characteristics of a metal powder were studied where the iron-based powder was a prealloyed iron material. The iron-based powder used in this experiment was Hoeganaes' 85HP powder, and the composition of the control powder is set forth in Table 5.1. The graphite, lubricant, and binding agent were the same materials as in Example 1. To this control powder was added 0.04% wt. of the Aerosil 200 silicon dioxide powder to prepare test Mix I.

TABLE 5.1

| Component | Reference Mix Wt. % |
|---|---|
| Ancorsteel 85HP Steel Powder | 94.9 |
| Nickel[1] | 4 |
| Graphite | 0.5 |
| Lubricant | 0.45 |
| Binder | 0.15 |

[1] - INCO Nickel Powder 123; INCO Ltd.

The flow characteristics for these two powders at various temperatures is set forth in Table 5.2. The introduction of the flow agent markedly extended the temperature region wherein the powder will flow.

TABLE 5.2

| | WT. % FLOW | TEMPERATURE (°F.) | | | | | |
|---|---|---|---|---|---|---|---|
| MIX | AGENT | 70 | 250 | 270 | 280 | 290 | 300 |
| Reference | 0 | 25.0 | NF | NF | NF | NF | NF |
| I | 0.04 | 25.0 | 25.0 | 27.0 | 27.0 | 27.0 | NF |

What is claimed is:

1. An improved metallurgical powder composition comprising:
   (a) at least about 85 percent by weight of an iron-based metal powder; and
   (b) from about 0.005 to about 2 percent by weight of particulate silicon oxide having an average particle size below about 40 nanometers.

2. The metallurgical powder composition of claim 1 wherein said particulate silicon oxide comprises silicon dioxide.

3. The metallurgical powder composition of claim 2 wherein the average particle size of said silicon dioxide is from about 1–35 nanometers.

4. The metallurgical powder composition of claim 2 further comprising from about 0.1 to about 10 percent by weight of a lubricant that is the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6.

5. The metallurgical powder composition of claim 2 wherein said iron-based powder comprises particles of iron pre-alloyed with at least one alloying element.

6. The metallurgical powder composition of claim 2 wherein said iron-based powder comprises particles of iron diffusion bonded with at least one alloying element.

7. The metallurgical powder composition of claim 2 wherein said iron-based powder comprises an alloying powder.

8. The metallurgical powder composition of claim 2 further comprising from about 0.01 to about 2 percent by weight particulate iron oxide having an average particle size of below 500 nanometers.

9. The metallurgical powder composition of claim 8 wherein the average particle size of said silicon dioxide is from about 1–35 nanometers.

10. The metallurgical powder composition of claim 9 wherein said iron oxide powder has an average particle size between about 25 and 300 nanometers.

11. The metallurgical powder composition of claim 1 wherein said particulate silicon oxide comprises about 0.01–1 percent by weight of said metallurgical powder composition.

12. The metallurgical powder composition of claim 11 wherein said particulate silicon oxide comprises silicon dioxide.

13. The metallurgical powder composition of claim 12 wherein said silicon dioxide is present in an amount of from 0.025 to 0.5 percent by weight of said metallurgical powder composition.

14. The metallurgical powder composition of claim 13 wherein said silicon dioxide powder has an average particle size of between about 1 and about 25 nanometers.

15. The metallurgical powder composition of claim 13 further comprising from about 0.1 to about 2 percent by weight of a lubricant, said lubricant being the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6.

16. The metallurgical powder composition of claim 15 wherein said iron-based powder comprises particles of iron admixed with an alloying powder that is present in an amount of from about 0.25 to about 5 percent by weight of said iron-based powder.

17. The metallurgical powder composition of claim 16 further comprising a binding agent in an amount of from about 0.005 to about 3 percent by weight of said iron-based powder.

18. The metallurgical powder composition of claim 14 further comprising particulate iron oxide having an average particle size of about 10–400 nanometers in an amount of about 0.01 to about 2 percent by weight of said metallurgical powder composition.

19. The metallurgical composition of claim 1 wherein the iron-based metal powder comprises a substantially pure iron powder in admixture with an alloying powder and wherein the metallurgical composition further comprises a binding agent that binds the iron powder to the alloying powder and wherein the particulate silicon oxide is a discrete powder in the metallurgical composition from the bound iron and alloying powder.

20. An improved metallurgical powder composition comprising:
   (a) at least about 85 percent by weight of an iron-based metal powder; and
   (b) from about 0.005 to about 2 percent by weight of a metal or metal oxide powder having an average particle size below about 500 nanometers.

21. The metallurgical powder composition of claim 20 wherein said metal of said metal or metal oxide nanoparticle material is selected from the group consisting of silicon, aluminum, copper, iron, nickel, titanium, gold, silver, platinum, palladium, bismuth, cobalt, manganese, magnesium, lead, tin, vanadium, yttrium, niobium, tungsten, and zirconium.

22. The metallurgical composition of claim 20 wherein the iron-based metal powder comprises a substantially pure iron powder in admixture with an alloying powder and wherein the metallurgical composition further comprises a binding agent that binds the iron powder to the alloying powder and wherein the particulate metal or metal oxide is a discrete powder in the metallurgical composition from the bound iron and alloying powder.

23. The metallurgical powder composition of claim 21 wherein the average particle size of the metal or metal oxide powder is below about 250 nanometers.

24. The metallurgical powder composition of claim 23 wherein the metal or metal oxide powder comprises iron oxide.

25. The metallurgical powder composition of claim 24 wherein the metal or metal oxide powder is present in an amount of from about 0.01 to about 1 percent by weight.

26. The metallurgical composition of claim 25 wherein the iron-based metal powder comprises a substantially pure iron powder in admixture with an alloying powder and wherein the metallurgical composition further comprises a binding agent that binds the iron powder to the alloying powder and wherein the particulate iron oxide is a discrete powder in the metallurgical composition from the bound iron and alloying powder.

27. The metallurgical powder composition of claim 23 wherein the metal or metal oxide powder is present in an amount of from about 0.01 to about 1 percent by weight.

28. The metallurgical powder composition of claim 27 wherein the average particle size of the metal or metal oxide powder is below about 100 nanometers.

29. The metallurgical powder composition of claim 28 wherein the metal or metal oxide powder comprises iron oxide.

30. The metallurgical composition of claim 29 wherein the iron-based metal powder comprises a substantially pure iron powder in admixture with an alloying powder and wherein the metallurgical composition further comprises a binding agent that binds the iron powder to the alloying powder and wherein the particulate iron oxide is a discrete powder in the metallurgical composition from the bound iron and alloying powder.

31. The metallurgical composition of claim 23 wherein the iron-based metal powder comprises a substantially pure iron powder in admixture with an alloying powder and wherein the metallurgical composition further comprises a binding agent that binds the iron powder to the alloying powder and wherein the particulate metal or metal oxide is a discrete powder in the metallurgical composition from the bound iron and alloying powder.

32. A method of making a compacted powder metallurgical part, comprising the steps of:

(a) providing a metallurgical powder composition comprising at least about 90 percent by weight of an iron-based metal powder, and from about 0.005 to about 2 percent by weight of a metal or metal oxide powder having an average particle size below about 500 nanometers; and (b) compacting the metallurgical powder composition in a die at a pressure of about 5–200 tons per square inch to form said part.

33. The method of claim 32 wherein said metal of said metal or metal oxide nanoparticle material is selected from the group consisting of silicon, aluminum, copper, iron, nickel, titanium, gold, silver, platinum, palladium, bismuth, cobalt, manganese, magnesium, lead, tin, vanadium, yttrium, niobium, tungsten, and zirconium.

34. The method of claim 32 wherein said metal or metal oxide nanoparticle material comprises from about 0.005 to about 2 percent by weight silicon oxide having an average particle size of below 40 nanometers.

35. The method of claim 34 wherein said metal or metal oxide nanoparticle material further comprises from about 0.01 to about 2 percent by weight particulate iron oxide having an average particle size of below 500 nanometers.

36. The method of claim 34 wherein the silicon oxide present in the metallurgical powder composition is present in an amount of from about 0.01 to about 1 percent by weight.

37. The method of claim 34 wherein the silicon oxide present in the metallurgical powder composition is present in an amount of from about 0.025 to about 0.5 percent by weight.

38. The method of claim 34 wherein said compaction is conducted at a temperature between 125° C. (260° F.) and 370° C. (700° F.).

39. The method of claim 34 wherein the metallurgical powder composition further comprises from about 0.1 to about 10 percent by weight of a lubricant that is the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6.

40. The method of claim 32 wherein the metallurgical powder composition further comprises from about 0.1 to about 10 percent by weight of a lubricant that is the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6.

41. The method of claim 32 wherein the average particle size of the metal or metal oxide powder present in the metallurgical powder composition is below about 250 nanometers.

42. The method of claim 41 wherein the metal or metal oxide powder present in the metallurgical powder composition is present in an amount of from about 0.01 to about 1 percent by weight.

43. The method of claim 42 wherein the metal or metal oxide powder present in the metallurgical powder composition comprises iron oxide.

44. The method of claim 43 wherein the metallurgical powder composition further comprises from about 0.1 to about 10 percent by weight of a lubricant that is the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6.

45. The method of claim 43 wherein said compaction is conducted at a temperature between 125° C. (260° F.) and 370° C. (700° F.).

46. The method of claim 43 wherein in the metallurgical composition the iron-based metal powder comprises a substantially pure iron powder in admixture with an alloying powder and wherein the metallurgical composition further comprises a binding agent that binds the iron powder to the alloying powder and wherein the particulate iron oxide is a discrete powder in the metallurgical composition from the bound iron and alloying powder.

47. The method of claim 42 wherein the average particle size of the metal or metal oxide powder present in the metallurgical powder composition is below about 100 nanometers.

48. The method of claim 47 wherein the the metal or metal oxide powder present in the metallurgical powder composition comprises iron oxide.

49. The method of claim 42 wherein the metallurgical powder composition further comprises from about 0.1 to about 10 percent by weight of a lubricant that is the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6.

50. The method of claim 42 wherein in the metallurgical composition the iron-based metal powder comprises a substantially pure iron powder in admixture with an alloying powder and wherein the metallurgical composition further comprises a binding agent that binds the iron powder to the alloying powder and wherein the particulate metal or metal oxide is a discrete powder in the metallurgical composition from the bound iron and alloying powder.

51. The method of claim 41 wherein the metal or metal oxide powder present in the metallurgical powder composition is present in an amount of from about 0.025 to about 0.5 percent by weight.

52. The method of claim 51 wherein the the metal or metal oxide powder present in the metallurgical powder composition comprises iron oxide.

53. The method of claim 32 wherein said compaction is conducted at a temperature between 125° C. (260° F.) and 370° C. (700° F.).

* * * * *